US006281863B1

(12) United States Patent
Sasaki et al.

(10) Patent No.: US 6,281,863 B1
(45) Date of Patent: Aug. 28, 2001

(54) PLASMA DISPLAY PANEL DRIVING SYSTEM AND METHOD

(75) Inventors: Takashi Sasaki, Hiratsuka; Masaji Ishigaki, Yokohama; Norio Yatsuda, Chigasaki; Yuji Sano, Zushi; Hiroshi Ohtaka, Yokohama; Nobuyuki Ushifusa, Yokohama; Eiji Matsuzaki, Yokohama; Seiichi Tsuchida, Yokosuka, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 08/744,759

(22) Filed: Nov. 6, 1996

(51) Int. Cl.[7] ..... G09G 3/28; H01J 17/49; H01J 1/88

(52) U.S. Cl. ..... 345/60; 345/68; 313/581; 313/585; 313/250; 313/281; 313/292; 315/169.1; 315/169.4

(58) Field of Search ..... 345/60–72; 313/581, 313/584, 585, 586, 587, 603, 610, 250, 257, 281, 292, 293; 315/169.4, 169.1, 349

(56) References Cited

U.S. PATENT DOCUMENTS 5,371,437 * 12/1994 Amano ..... 315/169.4
5,674,553 * 10/1997 Shinoda et al. ..... 427/68
5,744,909 * 4/1998 Amano ..... 313/585
5,889,501 * 3/1999 Sasaki et al. ..... 345/60

* cited by examiner

*Primary Examiner*—Bipin Shalwala
*Assistant Examiner*—David L. Lems
(74) *Attorney, Agent, or Firm*—Antonelli, Terry, Stout & Kraus, LLP

(57) ABSTRACT

A plasma display panel driving system and method for a display panel having a first common electrode and first independent electrodes arranged at a back plate side, a second common electrode and second independent electrodes arranged at a face plate side, an inner partition positioned between the first common and independent electrodes at the back plate side and the second common and independent electrodes at the face plate side and having an aperture therein connecting a space at the back plate side and a space at the face plate side, and a fluorescent layer arranged in the space at the face plate side. The driving system and method includes a driver for driving the first and second independent and common electrodes through a full writing period, a front surface erasing period, a writing period, and a discharge sustaining period, including supplying a first full writing pulse to the first common electrode at the back plate side and a second full writing pulse having a polarity which is opposite to the polarity of the first full writing pulse to the first independent electrodes at the back plate side for causing discharge between the first common and independent electrodes in the full writing period.

24 Claims, 8 Drawing Sheets

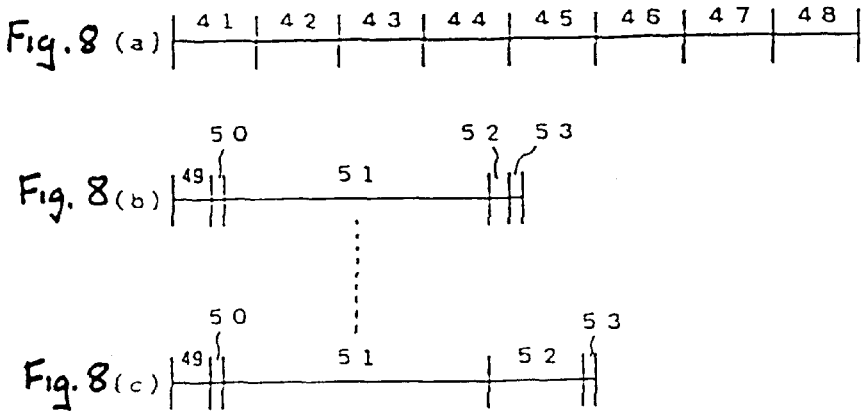
Fig. 8 (a)
41
42
43
44
45
46
47
48
Fig. 8 (b)
49
50
51
52
53
Fig. 8 (c)
49
50
51
52
53
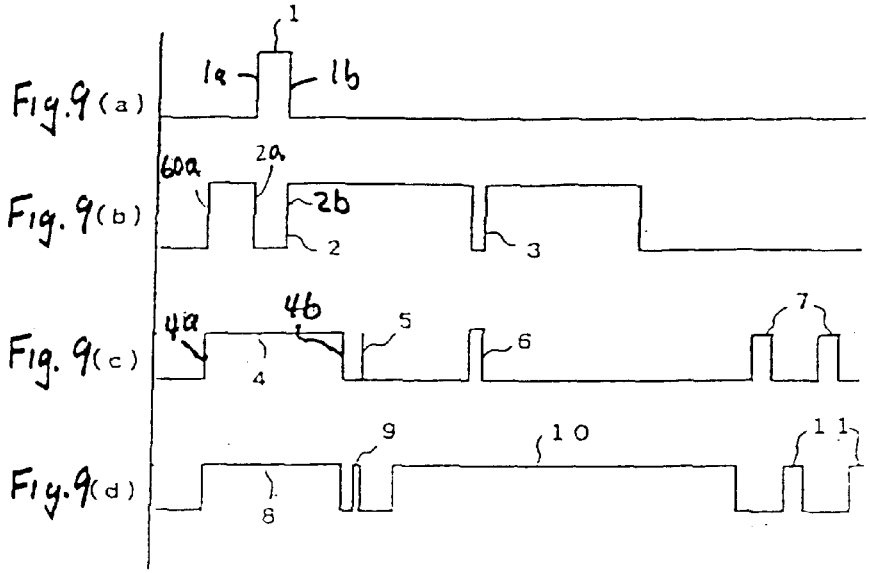
Fig. 9 (a)
1
1a
1b
Fig. 9 (b)
60a
2a
2b
2
3
Fig. 9 (c)
4a
4b
4
5
6
7
Fig. 9 (d)
8
9
10
11
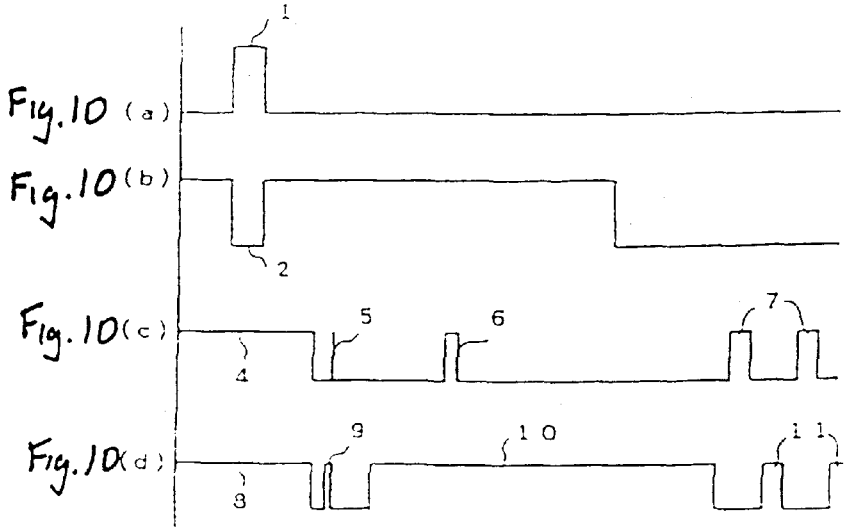
Fig. 10 (a)
1
Fig. 10 (b)
2
Fig. 10 (c)
4
5
6
7
Fig. 10 (d)
8
9
10
11

PLASMA DISPLAY PANEL DRIVING SYSTEM AND METHOD

CROSS REFERENCE TO RELATED APPLICATION

This application is related to copending U.S. application Ser. No. 08/525,975, entitled Gas Discharge Display Panel and Method Thereof, filed by all of the inventors herein and others, on Sep. 7, 1995.

BACKGROUND OF THE INVENTION

This invention relates to a memory type AC plasma display panel driving system and method used in a display device such as a personal computer or a work-station and a display device such as a flat wall-hanging type television or an advertisement or the like.

The prior art AC plasma display device is operated such that one light emitting display period is comprised of a full writing period, erasing period, a writing (address) period and a discharge sustaining period as disclosed Japanese Patent Application Laid-Open No. Hei 5-188877, for example, and pulses are applied to the X electrodes at the front surface side for the full writing operation and erasing operation.

However, in the prior art system described above, since the full writing is carried out by the electrodes at the front surface side of the display device, a phenomenon occurs that light emission occurs with the full writing even in the case that a black color displaying, i.e. a light emitting display is not performed, and further the black color is not displayed as a black color, but rather is displayed as a gray color and shows a problem that a contrast is decreased.

The present inventors and others, to solve such problems, invented a new plasma display panel as described in the copending application. The panel has a face plate, a back plate and a partition disposed therebetween. The face plate has a common electrode and a plurality of independent electrodes, and the back plate has a common electrode and a plurality of independent electrodes disposed perpendicular to those electrodes in the front panel so as to be able to do full writing in the back plate side. Further, the present inventors have developed a driving system and method for such plasma display panel.

SUMMARY OF THE INVENTION

It is an object of the present invention to provide a plasma display panel driving system and method in which contrast is improved.

It is another object of the present invention to provide a plasma display panel driving system and method in which discharging between electrodes at a back plate side is performed during the full writing period.

It is still another object of the present invention to provide a plasma display panel driving system and method in which any discharging during the full writing period is not carried out at the front plate side.

According to the present invention, the plasma display panel driving system includes a common electrode arranged at a back plate side, an independent electrode arranged parallel to and alternatively with the common electrode at the back plate side, a common electrode is arranged at a front or face plate side and extends transversely with respect to the electrodes arranged at the back plate side, an independent electrode is arranged parallel to and alternatively with the common electrode at the face plate side, an inner partition positioned between the electrodes at the back plate side and the electrodes at the face plate side and has an aperture connected between the space at the back plate side and the space at the face plate side, a fluorescent member or layer is arranged in the space at the face plate side, and a driver generator is provided for driving the electrodes through a full writing period, a front surface erasing period, a writing period, and a discharge sustaining period in each sub-field period and for supplying a first full writing pulse to the common electrode at the back plate side and for supplying a second full writing pulse whose polarity is opposite to the first full writing pulse to the independent electrode at the back plate side for enabling a discharge between the electrodes in the full writing period.

In accordance with the present invention, each of the light emitting display periods is divided into a full writing period, a front surface erasing period, a writing period and a discharge sustaining period, wherein full writing electrical discharging in the full writing period is carried out by the independent electrode and the common electrode arranged at the back plate side in the rear surface space having no fluorescent members, so that the light reaching the front surface side is merely a part of the electrical discharged light. Due to this fact, a volume of light reaching the front surface side is reduced and non-required light is reduced, so that contrast is improved.

The plasma display panel driving system further comprises a protecting pulse generator for supplying a protecting pulse to the independent electrode at the front or face plate side during the full writing period. The protecting pulse protects a discharging carried out between the electrode and the electrode at the back side plate.

According to a feature of the invention, a full writing pulse generator and a protecting pulse generator, etc. are used for driving the driving system.

These and other objects, features and advantages of the present invention will become more apparent from the following description when taken in conjunction with the accompanying drawings.

BRIEF DESCRIPTION OF THE DRAWINGS

FIGS. 8(*a*)–(*c*) are time-charts for one field period in a preferred embodiment of the driving system of the plasma display panel of the present invention.

FIGS. 9(*a*)–(*d*) are diagrams illustrating waveforms representing the driving waveforms of the sub-field period in the preferred embodiment of the driving system of the plasma display panel of the present invention.

FIGS. 10(*a*)–(*d*) illustrate an applied driving waveform of a sub-field period of a cell from which no light is emitted in one preferred embodiment of the driving system of the plasma display panel of the present invention.

DESCRIPTION OF THE PREFERRED EMBODIMENT

Figure 1:
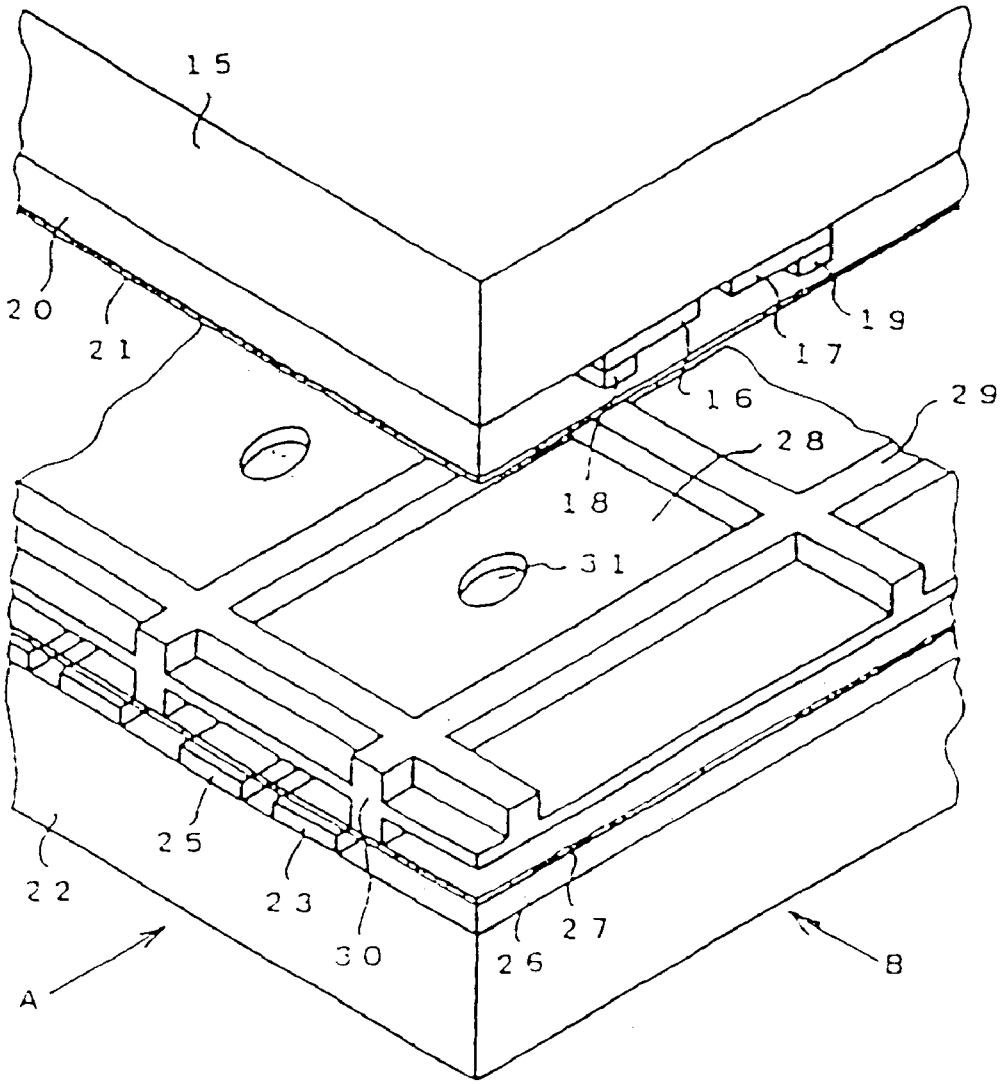
FIG. 1 is an exploded perspective view illustrating a part of a structure of the plasma display panel.

Referring now to the drawings, wherein like reference numerals are utilized to designate like parts throughout the several views, FIG. 1 is an exploded perspective view illustrating a part of the structure of the plasma display panel of the copending application utilized by the driving system of the present invention. Reference numeral 15 denotes a front or face glass plate having a common X electrode, an independent Y electrode 17, an X bus electrode 18, a Y bus electrode 19, a dielectric layer 20, and a protective layer 21 provided thereon. The panel also includes a back plate 22 having a common a electrode 23, an independent A electrode 25, a dielectric layer 26, and a protective layer 27 provided thereon. The panel also includes front and back partitions 28, a side partition 29, an inner partition 30, and an aperture 31, respectively. The electrode 16 is a transparent common X electrode 16 and the electrode 17 is a transparent independent Y electrode 17 which are arranged in parallel to one another at the lower surface of the face plate 15. In addition, the X bus electrode 18 is stacked on the common X electrode 16 and the Y bus electrode 19 is stacked on the independent Y electrode 17, respectively. Then, these electrodes are covered by the dielectric layer 20 and the protective layer 21 of MgO or the like.

In turn, the common a electrode 23 is arranged at the surface of the back plate 22 in a direction extending transversely or perpendicular to the electrodes on the front or face plate 15 and further there is provided the independent A electrodes 25 in parallel with the common a electrode 23, and these electrodes are covered by the dielectric layer 26 and the protective layer 27 of MgO or the like.

Between the face base plate 15 and the back base plate 22 is arranged the inner partition 30 having front and back partitions 28 for dividing a space between the base plates into an electrical discharging space (a main electrical discharging space) at the front surface (i.e. the face plate 15) and an electrical discharging space (a preliminary electrical discharging space) at the rear surface (i.e. the back plate 22) and having a side partition 29 for dividing each of the display cells. The inner partition 30 at the face plate 15 side is coated with a fluorescent member emitting light by a vacuum ultraviolet ray generated during electrical discharging.

In addition, the front and back partitions 28 are provided with apertures 31 for use in electrical discharging between the electrodes arranged at the face plate 15 and the electrodes arranged at the back plate 22. Further, an electrical discharging gas such as a rare gas as, for example, a neon gas with several percent of xenon gas is charged in these electrical discharging spaces.

Figure 2:
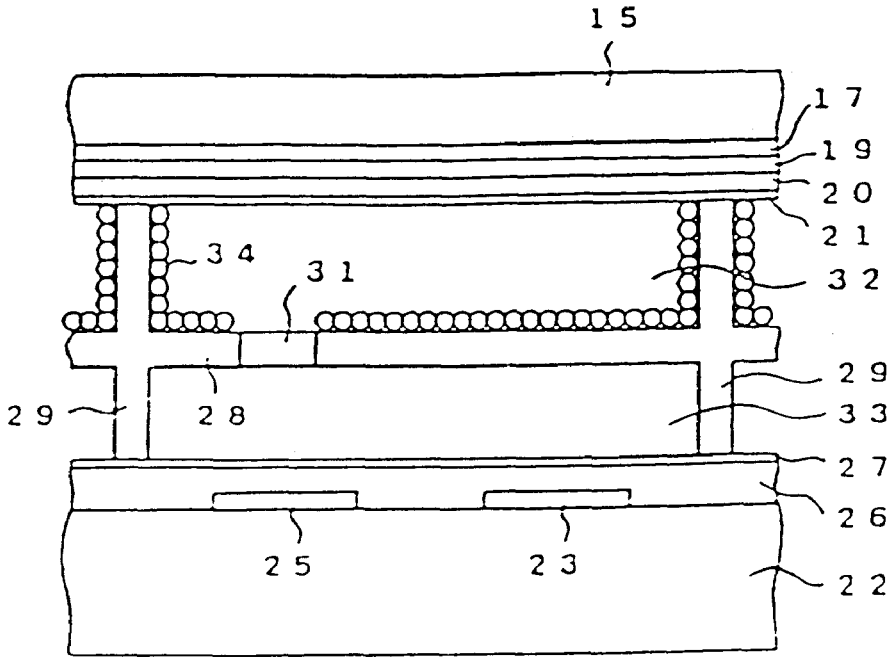
FIG. 2 is a sectional view in the direction of arrow A in the plasma display panel of FIG. 1.

FIG. 2 is a sectional view of the plasma display panel as seen from an arrow A in FIG. 1, wherein 32 denotes the main electrical discharging space, 33 denotes the preliminary electrical discharging space, and 34 denotes a fluorescent material layer. In this figure, the common a electrode 23 and the independent A electrode 25 are arranged in parallel to each other between the side partitions 29 on the back plate 22. Then, at the main electrical discharging space 32, the surface of the front and back partition 28 and the surface of the side partition 29 are coated with the fluorescent material layer 34, other than the preliminary electrical discharging space 33. In addition, the apertures 31 arranged at the front and back partition 28 for dividing the main electrical discharging space 32 and the preliminary electrical discharging space 33 are positioned above the independent A electrode 25.

Figure 3:
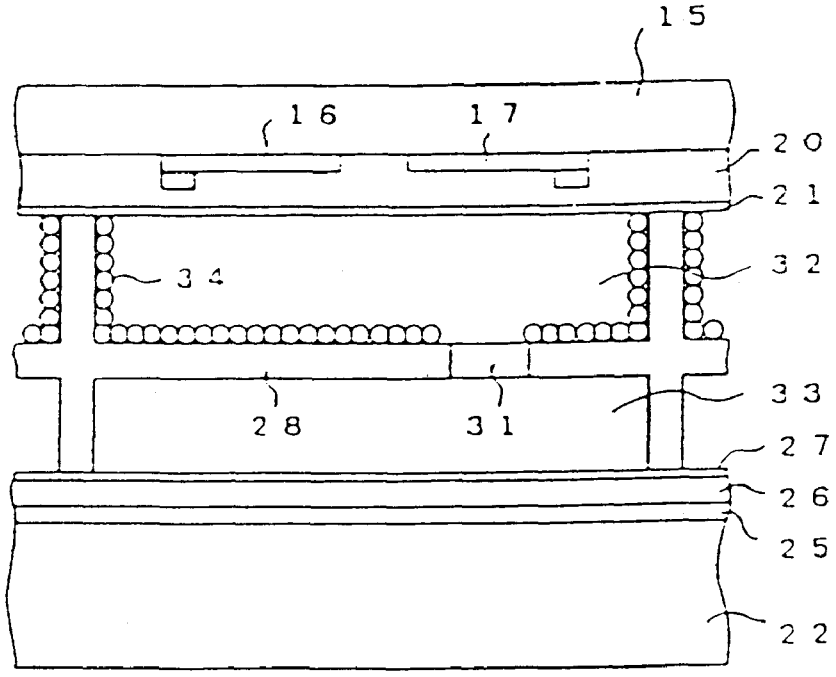
FIG. 3 is a sectional view in the direction of arrow B of the plasma display panel of FIG. 1.

FIG. 3 is a sectional view of the a plasma display panel as seen from an arrow B in FIG. 1. In this figure, the apertures 31 arranged at the front and back partitions 28 are positioned below the independent Y electrode 17. Accordingly, as viewed from FIG. 2, the apertures 31 are located at the crossing positions between the independent Y electrode 17 and the independent A electrode 25.

Figure 4:
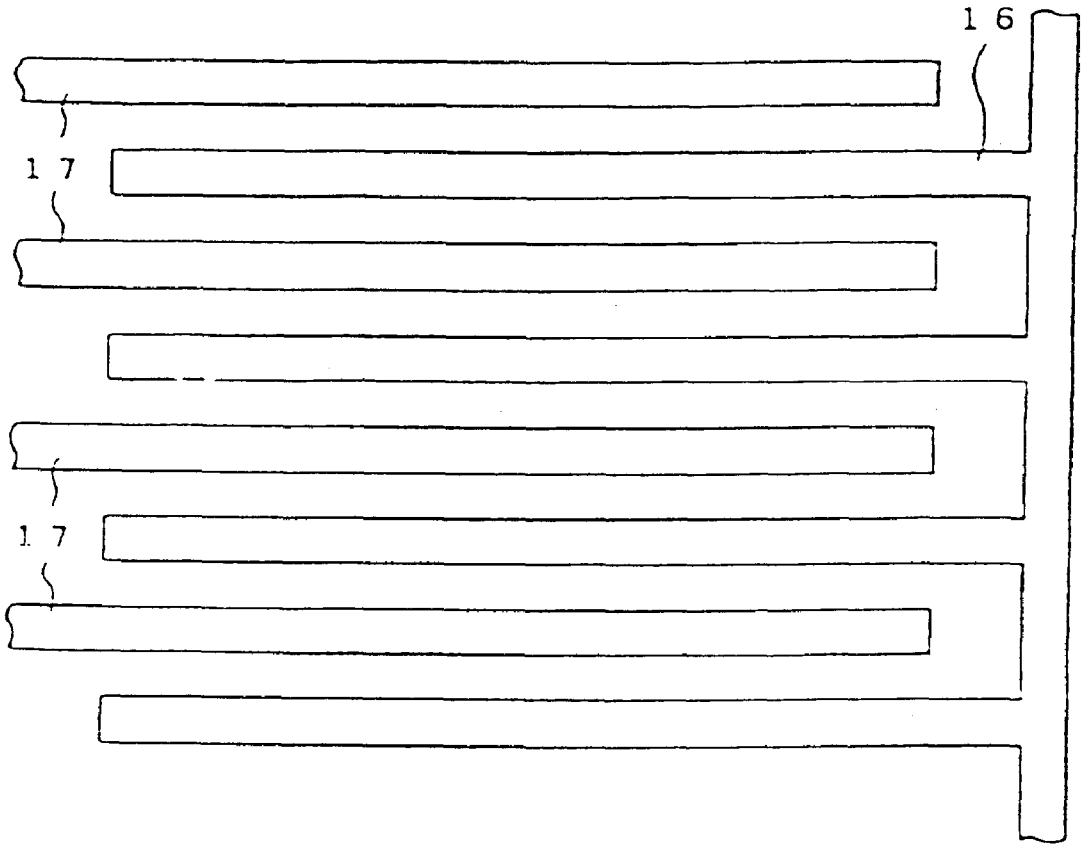
FIG. 4 is a top plan view illustrating a part of the electrode at the face plate in FIG. 1.

FIG. 4 is a top plan view illustrating a part of each of the common X electrode 16 and the independent Y electrodes 17 at the face plate 15 in FIG. 1. In this figure, although each of the independent Y electrodes 17 is made independent respectively, all of one ends of portions of the common X electrode 16 which extend in parallel with the independent Y electrode 17 are connected to each other.

Figure 5:
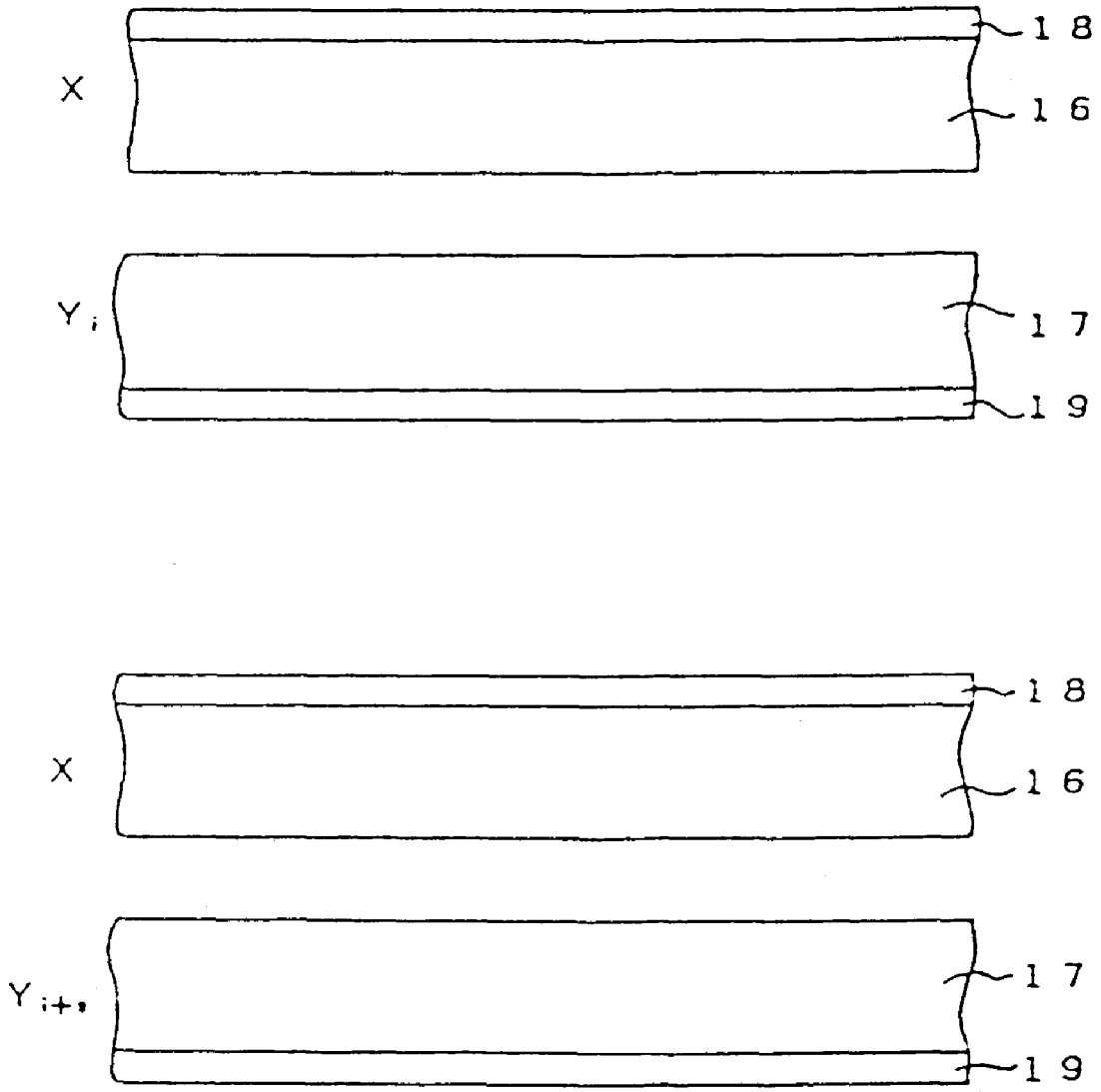
FIG. 5 is a top plan view illustrating a combination of electrodes for performing a main electrical discharging of cells at the face plate in FIG. 1.

FIG. 5 is a top plan view illustrating, in an enlarged scale, a part of the electrode structure for performing a main electrical discharging at the face plate 15. In this figure, one common X electrode 16 and the independent Yi electrode 17 form a set so as to perform a main electrical discharging of one cell. In addition, another common X electrode 16 and the independent Yi+2 electrode 17 form another set so as to perform a main electrical discharging of the adjoining cell.

Figure 6:
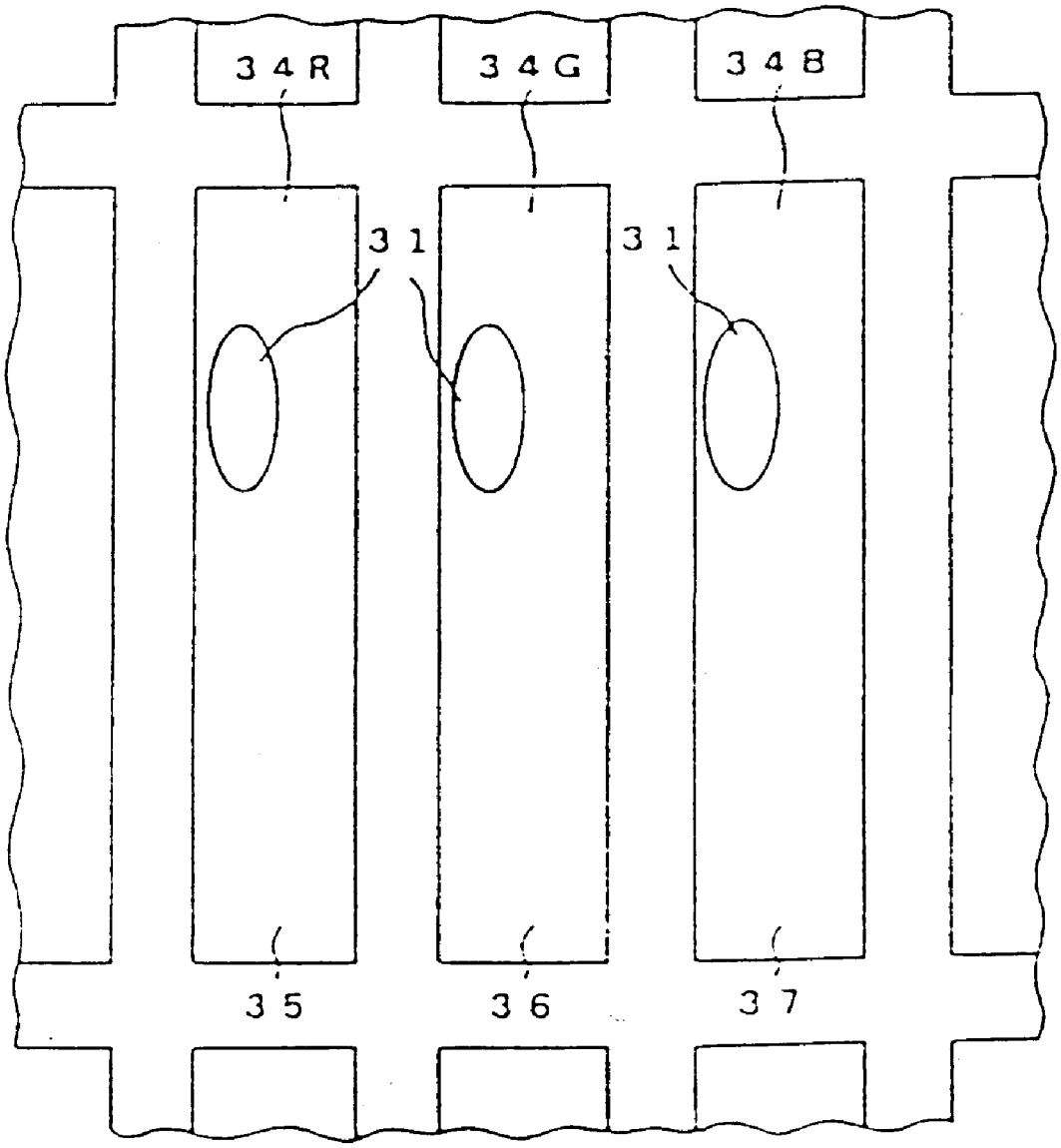
FIG. 6 is a top plan view illustrating an enlarged one pixel in the inner partition in FIG. 1.

FIG. 6 is a top plan view illustrating, in an enlarged scale, one pixel of the inner partition 30 in FIG. 1, wherein 34R, 34G and 34B denote fluorescent members and 35 to 37 denote cells. In this figure, the adjoining three cells 35, 36 and 37 are coated with fluorescent members 34R, 34B and 34G generating red light, blue light and green light, respectively, wherein one pixel is formed by these three cells 35, 36 and 37.

Figure 7:
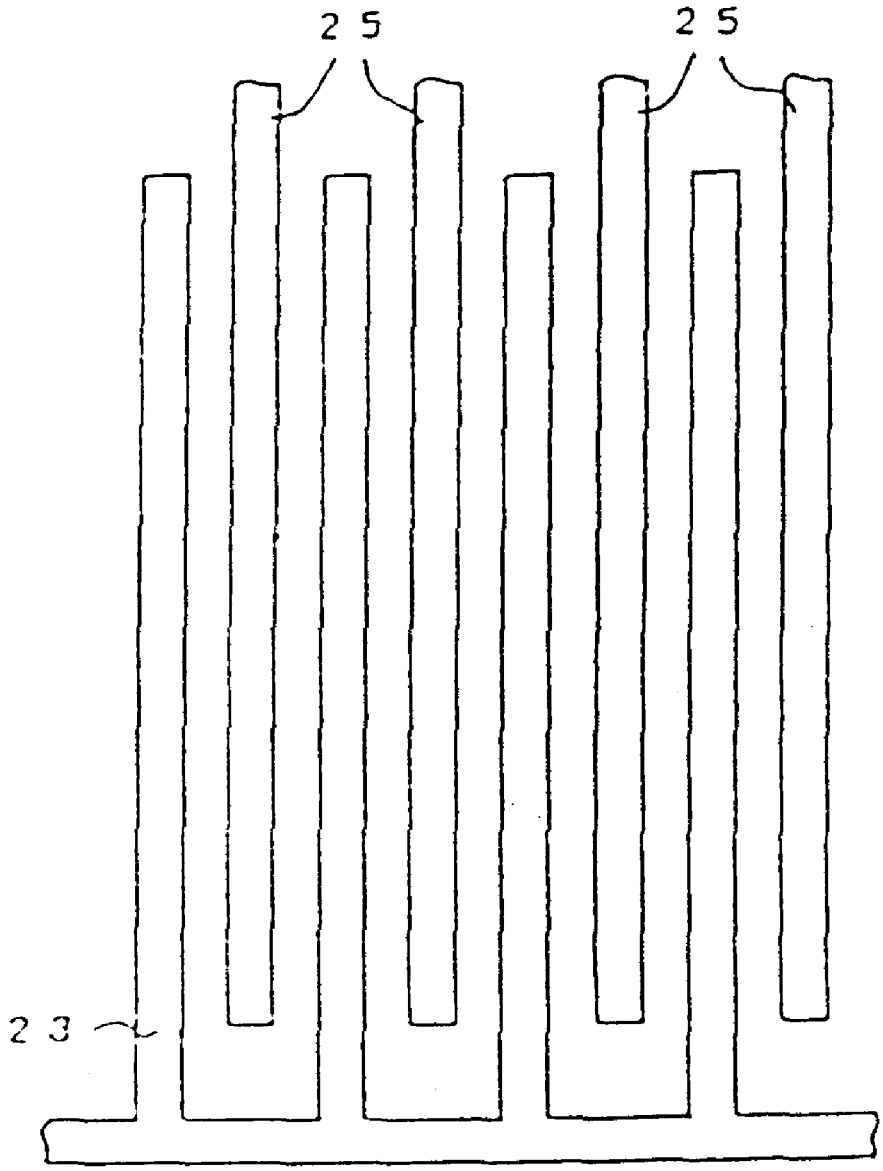
FIG. 7 is a top plan view illustrating a part of the electrode at the back plate of FIG. 1.

FIG. 7 is a top plan view illustrating, in an enlarged scale, a part of the electrode at the back plate 22 in FIG. 1. In this figure, although each of the independent A electrodes 25 is independent from one another, one end of portions of the common a electrode 23 extending in parallel with the independent A electrodes 25 are connected to each other.

The inner partition 30 of the panel is held and sealed by the front surface glass base plate 15 and the back plate 22 having the aforedescribed structure, and the electrical discharge gas is provided in the areas delimited by the partition to construct the plasma display panel.

FIGS. 8(*a*)–(*c*) illustrate a driving timing of one field corresponding to the displaying period of one image. As shown in FIG. 8(*a*), one field period corresponding to a displaying period of one image is divided into eight sub-fields 41 to 48, wherein each of the sub-fields 41 to 48 is, as shown in FIGS. 8(*b*) and (*c*),divided into a full writing period 49, a front surface erasing period 50, a writing period 51, an electrical discharge sustaining period 52 and a blank period 53. The number of the discharge sustaining pulses are, for example, 1, 2, 4, 8, 16, 32, 64, 128, but the numbers of pulses may take same number in different sub-fields.

FIGS. 9(*a*)–(*d*) illustrate driving waveforms of the plasma display panel in each of the sub-fields, wherein FIG. 9(*a*) indicates a driving waveform applied to the common electrode a electrode 23 arranged at the back plate 22 and this is comprised of the full writing pulses 1, and FIG. 9(*b*) indicates a driving waveform applied to the independent A electrodes 25 arranged at the back plate 22, and this is comprised of the full writing pulse 2 and the writing pulse 3. The full writing pulses 1 and 2 are applied at substantially the same time, i.e. concurrently.

FIG. 9(*c*) indicates a driving waveform applied to the independent Y electrodes 17 arranged at the face plate 15 and this is comprised of a protecting pulse 4, a short erasing pulse 5, a writing pulse 6 and electrical discharge sustaining pulses 7. The writing pulses 3, 6 which have opposite polarities are applied at approximately the same time, and pulse widths are approximately 1 to 4 μsec. FIG. 9(*d*) indicates a driving waveform applied to the common X electrode 16 arranged at the face plate 15, wherein this waveform is comprised of a protecting pulse 8, a short erasing pulse 9, a pulling-up pulse 10 and electrical discharge sustaining pulses 11. The protecting pulses 4, 8 are applied at approximately the same time beginning at a time about 10 μsec before the application of the full writing pulses 1, 2 and being continuously applied up to a time of at least about 10 μsec after the application of the full writing pulses 1 and 2. The full writing pulses are applied to all the independent A electrodes 25, and thee protecting pulses 4 are applied to all the independent Y electrodes 17.

At the full writing period 49 at each of the sub-fields 41 to 48 shown in FIGS. 8(*a*)–(*c*), the full writing electrical discharge is carried out at the preliminary electrical discharging space 33 (FIGS. 2 and 3) with the full writing pulse 2 applied to the independent A electrodes 25 arranged at the back plate 22 and the full writing pulse 1 applied to the common a electrode 23. With such an arrangement as described above, states of electrical loads of all cells at the back plate 22 are made uniform. Since the full writing electrical discharging is carried out in the preliminary electrical discharging space 33 having no fluorescent material layer, the light emission is carried out only with the electrical discharged light of the gas electrically discharging in the discharging space 33. In addition, at a part other than the apertures 31, since the preliminary electrical discharging space 33 is shielded by the front and back partition 28, light only reaches the face plate 15 through the apertures 31 and a reduced light reaches the face plate 15.

In case of supplying the full writing pulses 1 and 2 to the common a electrode 23 and to the independent A electrodes 25 respectively, the following defects arises. To supply the full writing pulse 2 to the independent A electrode, a voltage which rises at 60*a* is supplied before the full writing pulse 2 to the independent A electrodes 25. At such time, there arises the possibility of an occurrence of a discharge between the independent A electrodes 25 and the independent Y electrodes 17. The occurrence of the discharging depends upon the condition of the air around the electrodes 17 and 25. If the air in the vicinity of the electrodes 17 and 25 is ionized, the discharging easily occurs at the rising edge 60*a* of the voltage.

To prevent the discharging between the independent A electrodes 25 and the independent Y electrodes 17 at the rising edge 60*a*, the protecting pulse 4 which rises at the same time with the rising edge 60*a* is supplied to the independent Y electrodes 17. The voltage of both independent A electrodes 25 and the common a electrode 23 are maintained at zero through the discharge sustaining period, so that plus or minus electric charges which are produced during the discharge sustaining period do not exist around the electrodes 23 and 25, and a voltage difference caused by the electric charge does not occur. Therefore, the voltage actually supplied to the independent A electrodes 25 is the voltage difference between the independent A electrodes 25 and the common a electrode 23. The level of the voltage supplied to the independent A electrodes 25 is determined such that the discharging does not occur between the independent A electrodes 25 and the common a electrode 23.

According to an experiment by the inventors, it is suitable for the plasma display panel illustrated in FIG. 1 that the voltage supplied to the independent A electrodes 25 is 150 volts or less, the full writing pulse 1 is 200–300 volts, and the protecting pulse 4 and 8 are 150–200 volt.

In case the interval of the rising edge 4*a* of the protecting pulse 4 and falling edge 2*a* of full writing pulse 2 is short, there is a possibility of an occurrence of discharge between the rising edge 4*a* of the protecting pulse 4 and the falling edge 2*a* of the writing pulse 2. To prevent the discharging, the interval between edge 4*a* of the protecting pulse and the falling edge 2*a* of the writing pulse 2 is made 10 μsec or more.

The phenomena of the occurrence of the discharging is not fully resolved. In case the interval between the rising edge 4*a* of the protecting pulse 4 and the falling edge 2*a* of full writing pulse 2 is shorter than a predetermined period, a discharging is generated by the voltage difference between the voltage at the edge 4*a* of the protecting pulse 4 and the voltage at the edge 2*a* of the full writing pulse 2. When the interval between the rising edge 4*a* and the falling edge 2*a* are longer than a predetermined period, minus electric charges gather in the vicinity of the independent A electrodes 25 and in the vicinity of the independent Y electrodes 17 because of the high voltage thereof, and the minus electric charge lowers the actual voltage difference. As a result, the discharge between the independent A electrodes 25 and the independent Y electrodes 17 does not occur.

In case the interval between the rising edge 2*b* of the full writing pulse 2 and the falling edge 4*b* of the protecting pulse 4 is shorter than a predetermined period, discharge between the independent A electrodes 25 and the independent Y electrodes 17 may occur for the following reasons. By supplying the full writing pulse 1 to the common a electrode 23 and supplying the full writing pulse 2 to the independent A electrodes 25, a discharging between the common a electrode 23 and the independent A electrodes occurs. (Actually, the discharging occurs at the falling edge 2*a* of the writing pulse 2 and the rising edge 1*a* of the common a electrode 23.) Plus electric charges gather in the vicinity of the independent A electrodes 25 during the period of supplying the full writing pulse 2. The plus electric charges are added to the voltage at the edge 2*b* of the full writing pulse 2. In case the interval of the edge 2*b* of the full writing pulse 2 and the edge 4*b* of the protecting pulse 4 is shorter than a predetermined period, discharging occurs between the independent A electrodes 25 and the independent Y electrodes 17, because the plus electric charges are added to the voltage at the edge 2*b*. In case the interval between the edges 2*b* and 4*b* is determined to be longer than a predetermined period, the voltage at the independent A electrodes 25 is maintained at a high voltage after the pulse 2, and minus electric charges being to gather in the vicinity of the independent A electrodes 25. As a result, the plus electric charges at the edge 2*b* are neutralized, or the voltage of the independent A electrodes 25 is actually reduced by the minus electric charges, and discharging between the independent A electrodes 25 and the independent Y electrodes 17 is prevented.

By the inventors' experiment using the plasma panel disclosed in FIG. 1, it has that the discharging is prevented by making the interval between the edge 2*b* of the writing pulse 2 and the edge 4*b* of the protecting pulse 4 about 10 μsec or more.

As explained above, the discharging which may occur between the independent A electrodes 25 and the independent Y electrodes 17 during full the writing period is effectively prevented by supplying the protective pulse 4 to the independent Y electrodes 17.

In case the protecting pulse 4 is supplied to the independent Y electrodes 17, however, a discharging between the independent Y electrodes 17 and the common X electrode 16 has a possibility of occurrence because the voltage of the protecting pulse 4 is about 150–200 volts. To prevent this discharging, the protection pulse 8 which is substantially the same as the pulse 4 is supplied to the common X electrode 16. By supplying the protection pulse 8 to the common X electrode 16, the discharging between the independent Y electrodes 17 and the common X electrode 16 is prevented. Further, by supplying the protecting pulses 4 and 8 to the independent Y electrodes 17 and the common X electrode 16 respectively, the plus electric charge in the preliminary electrical discharging space 33 is restricted to move though the aperture 31 into the vicinity of the independent Y electrodes 17 and the common X electrode 16.

As explained above, the discharging is formed in the preliminary electrical discharging space 33 by supplying the full writing pulse 1 to the common a electrode 23, and by supplying the full writing pulse 2 to the independent A electrodes 25. The discharging is formed in each sub-field period. Further, the protecting pulses 4 and 8 which are supplied to the independent Y electrodes 17 and the common X electrode 16, respectively, protect the minus electric charges in the preliminary electrical discharging space 33 from moving into the main electrical discharging space 32 through the aperture 31.

After this operation, at the front surface erasing period 50, electrical loads of all cells at the front surface glass base plate 15 are eliminated by the short erasing pulse 9 applied to the common X electrode 16 arranged at the front surface glass base plate 15 and the short erasing pulse 5 applied to the independent Y electrodes 17. The pulse width of the short erasing pulse 5 is narrower than the pulse width of the short erasing pulse 9.

In case the main electrical discharging space 32 has plus electrical charges, a discharging occurs between the common X electrode 16 and the independent Y electrodes 17 by supplying the short erase pulse 9 to the common X electrode 16. The discharging occurs mainly at the rising edge of the short erase pulse 9. Minus electric charges which are generated by the discharging begin to gather in the vicinity of the common X electrode 16 at latter half of the short erase pulse 9, and the plus electric charge in the main electrical discharging space 32 is neutralized by the minus electric charge. Then, the short erase pulse 5 which has a pulse width narrower than the short erase pulse 9 is supplied to the independent Y electrodes 17. In case the main electrical discharging space 32 has electrical charges, a discharging is caused between the independent Y electrodes 17 and the common X electrode 16. The pulse width of the short erase pulse 5 is so narrow that the short erase pulse 5 falls before the discharging is over and the electric charge generated by the discharging remains in the main electrical discharging space 32 for neutralization.

Subsequent to the front surface erasing period 50, as shown in FIGS. 8(*b*) and (*c*), there is provided a writing period 51 for restricting the cell for light emitting display. At the writing period 51, the pulling-up pulse 10 is applied in such a manner that the common X electrode 16 shows a high potential level in advance in order to perform an effective utilization of the charged particles Generated by the writing electrical discharging. By supplying the pulling up pulse 10 to the common X electrode 16, minus electric charges gather in the vicinity of the common X electrode 16 and plus electric charges gather in the vicinity of the independent Y electrodes 17, and as a result, a discharging is certainly effected in the discharging sustaining period. That is, the voltage of the discharge sustaining pulses 7 and 11 are determined so as to effect discharging only in the presence of the electric charges and not to effect discharge without these electric charges. Before this operation, the writing electrical discharging is carried out with the writing pulse 3 of about 1 to 4 μsec applied to the independent A electrodes 25 arranged at the rear surface glass plate 22 and the writing pulse of about 1 to 4 μsec applied to the independent Y electrodes 17 arranged at the front surface glass base plate 15.

In the writing period, writing pulses 6 whose pulses are deviated by a pulse width are supplied in sequence to the respective independent Y electrodes 17 (Y1, Y2, Y3, Ym) and the writing pulses 3 are supplied to the selected independent A electrodes. In case the writing pulse 6 is supplied to the Y1 electrode, discharging occurs at the intersecting point of the Y1 electrode 17 and the selected independent A electrodes 25. Upon completion of the writing operation, the independent A electrodes 25 and the common X electrode 16 are returned to their lower potential in this order and the cell advances to the maintaining electrical discharging period 52.

In addition, it is also possible that a potential between the writing pulse 3 applied to the independent A electrodes 25 and the writing pulse 6 applied to the independent Y electrodes 17 may be lower than a potential difference between the full writing pulses 1, 2 due to a surplus of the charged particles caused by the full writing electrical discharging. The discharge sustaining pulse 7 is supplied to the independent Y electrodes 17, and the discharge sustaining pulse 11 is supplied to the common X electrode 16 during the discharge sustaining period. By the supplying of the discharge sustaining pulses 7 and 11, discharge occurs only in the part where the electric discharge is generated during the writing period and the fluorescence is brightened by the discharging. The number of the discharge sustaining pulses 7 and 11 are determined in each sub-field.

FIGS. 10(*a*)–(*d*) show a driving waveform of a cell in which light is not emitted. FIG. 10(*a*) shows a driving waveform applied to the common a electrode 23. FIG. 10(*b*) shows a driving waveform applied to the independent A electrodes 25, and as is apparent from comparison with FIG. 9(*b*), only the full writing pulse 2 is applied and no writing pulse 3 is applied at the writing period 51. Due to this fact, writing electrical discharge is not performed even through the writing pulse 6 is applied to the independent Y electrodes 17 as shown in FIG. 10(*c*) and therefore no charged particles are generated. Accordingly, even if the maintaining pulses 7, 11 are applied and the driving waveforms applied to the common X electrode 16 as shown in FIG. 10(*d*), electrical discharging is not produced. In this way, it is possible to drive the plasma display panel and further to prevent a reduction in contrast.

Figure 11:
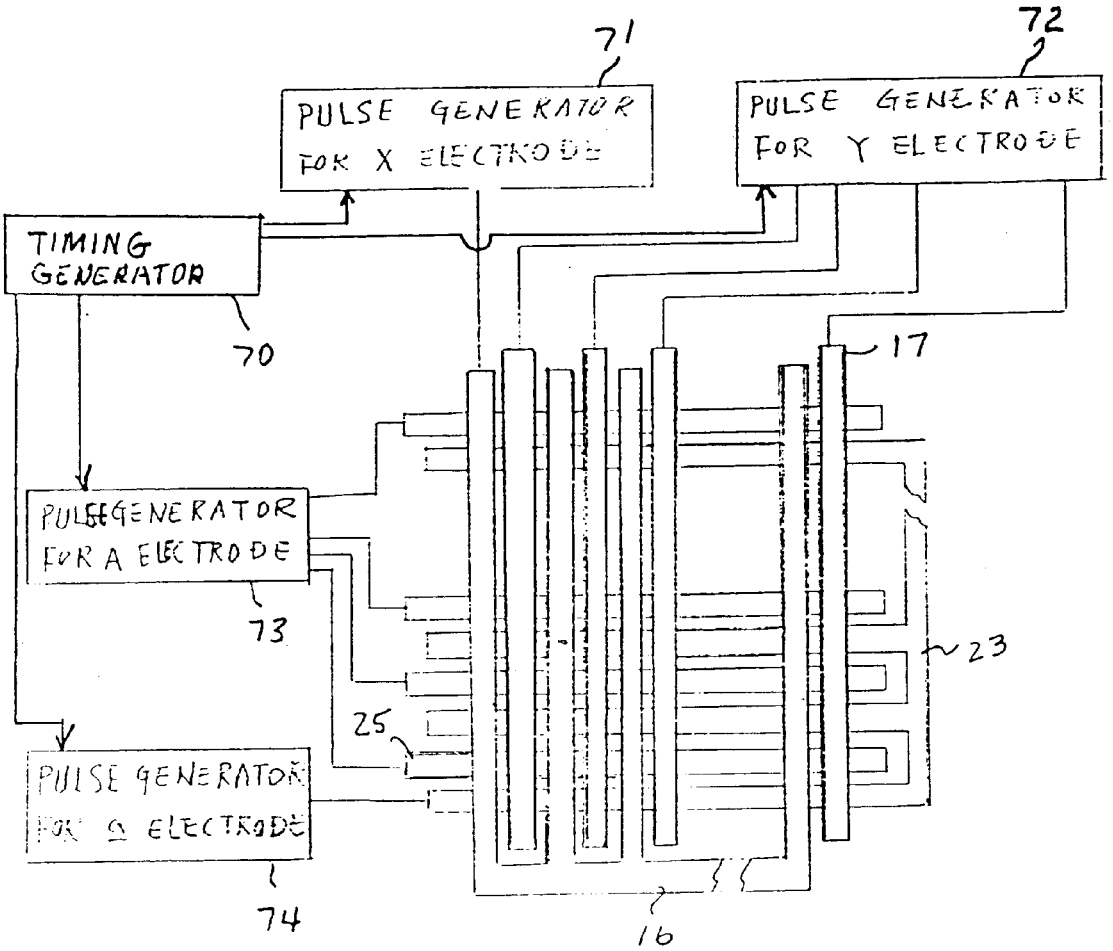
FIG. 11 illustrates a driving system in accordance with an embodiment of the present invention.

FIG. 11 shows a block diagram arrangement of a driving system wherein a pulse generator 71 supplies pulses in accordance with FIGS. 9(*d*) and 10(*d*) to the common X electrode 16, a pulse generator 72 supplies pulses in accordance with FIGS. 9(*c*) and 10(*c*) to the independent Y electrodes 17, a pulse generator 73 supplies pulses in accordance with FIGS. 9(*b*) and 10(*b*) to the independent A electrodes 25 and a pulse generator 74 supplies pulses in accordance with FIGS. 9(*a*) and 10(*a*) to the common a electrode 23, with the pulse generators being controlled in timing by a timing generator 70.

As described above, according to the present invention, it is possible to improve a contrast by driving the plasma display panel and reducing a light of full writing reaching to the front surface side. Further, according to the invention, unexpected discharge during full writing period is prevented and the operation is stabilized.

While we have shown and described embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

What is claimed is:

1. A plasma display panel driving system for a display panel having a first common electrode arranged at a back plate side, first independent electrodes arranged to extend parallel to and alternately with portions of said first common electrode at the back plate side, a second common electrode arranged at a face plate side and having portions extending transversely to said portions of said first common electrode and said first independent electrodes arranged at the back plate side, second independent electrodes arranged to extend parallel to and alternately with said portions of said second common electrode at the face plate side, an inner partition positioned between said first common and first independent electrodes at the back plate side and said second common and second electrodes at the face plate side and having an aperture therein connecting a space at the back plate side and a space at the face plate side, and a fluorescent layer arranged in said space at the face plate side, said driving system comprising a driver for driving said first and second independent and common electrodes through a full writing period, a front surface erasing period, a writing period, and a discharge sustaining period, said driver including means for supplying a first full writing pulse to said first common electrode at the back plate side and for supplying a second full writing pulse having a polarity which is opposite to the polarity of said first full writing pulse to said first independent electrodes at the back plate side for causing discharge between said first common electrode and said first independent electrodes in the full writing period.

2. A plasma display panel driving system according to claim 1, wherein said driver effects driving for a period comprised of a plurality of sub-field periods, wherein each sub-field period includes the full writing period, the front surface erasing period, the writing period and the discharge sustaining period.

3. A plasma display panel driving system according to claim 2, wherein the period comprised of the plurality of sub-fields is one field period for display of one image.

4. A plasma display panel driving system according to the claim 1, wherein said aperture is provided at the point of intersection of one of said first independent electrodes at the back plate side and one of said second independent electrodes at the face plate side.

5. A plasma display panel driving system according to the claim 1, wherein said driver further includes a generator for supplying a protecting pulse to said second independent electrodes at the face plate side during the full writing period.

6. A plasma display panel driving system according to claim 5, wherein said driver further includes another generator for supplying another protecting pulse to said second common electrode at the face plate side during the full writing period.

7. A plasma display panel driving system according to the claim 1, wherein said driver further includes at least one protection pulse generator for supplying at least one protecting pulse having a polarity which is the same as an initial polarity of a pulse supplied to said first independent electrodes at the back plate side to said second independent electrodes at the face plate side during the full writing period for preventing discharges between said first and second independent electrodes at the back plate side and the face plate side, respectively, and between said first independent electrode at the back plate side and said second common electrode at the face plate side.

8. A plasma display panel driving system according to the claim 7, further comprising another protection pulse generator for supplying another protection pulse of the same polarity and the same timing as the at least one protection pulse to said second common electrode at the face plate side.

9. A plasma display panel driving system according to any one of claims 5, 6, 7 or 8, wherein said second full writing pulse has a first edge and a second edge substantially delimiting the width thereof, and said at least one protecting pulse has a first edge starting before the first edge of said second full writing pulse and has a second edge ending after the second edge of said second full writing pulse.

10. A plasma display panel driving system according to claim 9, wherein an interval between said first edge of said at least one protecting pulse and said first edge of said second full writing pulse is at least 10 $\mu$sec, and an interval between said second edge of said second full writing pulse and said second edge of said at least one protecting pulse is at least 10 $\mu$sec.

11. A plasma display panel driving system according to claim 1, wherein said driver further includes a generator for supplying a short erase pulse to at least one of said second independent electrodes at the face plate side during the front surface erasing period after said full writing period.

12. A plasma display panel driving system according to claim 11, wherein said driver further includes a generator for supplying a short erase pulse to said second common electrode at the face plate side during the front surface erasing period after said full writing period.

13. A plasma display panel driving system according to claim 12, wherein said short erase pulse applied to one of said at least one second independent electrodes and said second common electrode has a pulse width narrower than a pulse width of said short erase pulse applied to the other of said at least one second independent electrodes and said second common electrode.

14. A plasma display panel driving system according to claim 1, wherein said driver further comprises at least one writing pulse generator for supplying a first writing pulse having a pulse width of 1 $\mu$sec to 4 $\mu$sec to said first independent electrodes at the back plate side and for supplying a second writing pulse having the same pulse width and opposite polarity as said first writing pulse to said second independent electrodes at the face plate side for performing writing discharging between said first and second independent electrodes, and means for maintaining said second common electrode at the face plate side at a high voltage at least during application of said first and second writing pulses.

15. A plasma display panel driving system according to claim 1, wherein said driver further includes means for supplying at least one pulse to at least one of said second independent electrodes and said second common electrode during said discharge sustaining period after said writing period.

16. A plasma display panel driving system for a display panel having a first common electrode arranged at a back plate side, first independent electrodes arranged to extend parallel to and alternately with portions of said first common electrode at the back plate side, a second common electrode arranged at a face plate side and having portions extending transversely to said portions of said first common electrode and said first independent electrodes arranged at the back plate side, second independent electrodes arranged to extend parallel to and alternately with said portions of said second common electrode at the face plate side, an inner partition positioned between said first common and first independent electrodes at the back plate side and said second common and second electrodes at the face plate side and having an aperture therein connecting a space at the back plate side and a space at the face plate side, and a fluorescent layer arranged in said space at the face plate side, said driving system comprising:

driving means for driving said first and second common and independent electrodes through a full writing period, a front surface erasing period, a writing period, and a discharge sustaining period in each sub-field period of one field period for display of one image, said driving means including;

first means for supplying a first full writing pulse to said first common electrode at the back plate side and for supplying a second full writing pulse having a polarity which is opposite to said first full writing pulse to said first independent electrodes at the back plate side for causing discharge between said first common electrode and said first independent electrodes in the full writing period;

second means for supplying at least one protecting pulse during the full writing period;

third means for supplying at least one short erase pulse during the front surface erasing period;

fourth means for supplying at least one writing pulse during the writing period; and fifth means for supplying at least one discharge sustaining pulse during the discharge sustaining pulse;

wherein said first means supplies said first full writing pulse to said common electrode at the back plate side, said first means and said fourth means supply said second full writing pulse and said writing pulse to said first independent electrodes at the back plate side, said second means and said third means supply said at least one protecting pulse, said at least at least one short erase pulse and said at least one discharge sustaining pulse to said second independent electrodes at the face plate side, and said second means and said third means supply said at least one protecting pulse, said at least one erasing pulse and said at least one discharge sustaining pulse to said second common electrode at the face plate side.

17. A plasma display panel driving system according to claim 16, wherein said driving means further includes sixth means for maintaining said second common electrode at the face plate side at a high voltage at least during application of the at least one writing pulse in the writing period.

18. A plasma display panel driving method for a display panel having a first common electrode arranged at a back plate side, first independent electrodes arranged to extend parallel to and alternately with portions of said first common electrode at the back plate side, second common electrode arranged at a face plate side and having portions extending transversely to said first common and first independent electrodes arranged at the back plate side, a second independent electrodes arranged to extend parallel to and alternately with said portions of said second common electrode at the face plate side, an inner partition positioned between said first common and first independent electrodes at the back plate side and said second common and said second independent electrodes at the face plate side and having an aperture therein connecting a space at the back plate side and a space at the face plate side, and a fluorescent layer arranged in said space at the face plate side, said driving method comprising the steps of driving said first and second independent and common electrodes through a full writing period, a front surface erasing period, a writing period, and a discharge sustaining period including supplying a first full writing pulse to said first common electrode at the back plate side and supplying a second full writing pulse having a polarity which is opposite to the polarity of said first full writing pulse to said first independent electrodes at the back plate side for causing discharge between said first common electrode and said first independent electrodes in the full writing period.

19. A plasma display panel driving method according to the claim 18, further comprising the step of supplying a protecting pulse to said second independent electrodes at the face plate side during the full writing period.

20. A plasma display panel driving method according to the claim 19, further comprising the step of supplying another protecting pulse to said second common electrode at the face plate side during the full writing period.

21. A plasma display panel driving method according to the claim 18, further comprising the steps of for supplying at least one protecting pulse having a polarity which is the same as an initial polarity of a pulse supplied to said first independent electrodes at the back plate side to said second independent electrodes at the face plate side during the full writing period for preventing discharges between said first and second independent electrodes at the back plate side and the face plate side, respectively, and between said first independent electrode at the back plate side and said second common electrode at the face plate side.

22. A plasma display panel driving method according to the claim 21, further comprising the step of supplying another protection pulse of the same polarity and the same timing as the at least one protection pulse to said second common electrode at the face plate side.

23. A plasma display panel driving method according to any one of claims 19, 20, 21 or 22, wherein said second full writing pulse has a first edge and a second edge substantially delimiting the width thereof, and said at least one protecting pulse has a first edge starting before the first edge of said second full writing pulse and has a second edge ending after the second edge of said second full writing pulse.

24. A plasma display panel driving system according to claim 23, wherein an interval between said first edge of said at least one protecting pulse and said first edge of said second full writing pulse is at least 10 $\mu$sec, and an interval between said second edge of said second full writing pulse and said second edge of said at least one protecting pulse is at least 10 $\mu$sec.

* * * * *